United States Patent [19]

Scott

[11] Patent Number: 4,964,790

[45] Date of Patent: Oct. 23, 1990

[54] AUTOMATIC REGULATION OF BALANCING PRESSURE IN A SCREW COMPRESSOR

[75] Inventor: James C. Scott, Michigan City, Ind.

[73] Assignee: Sundstrand Corporation, Rockford, Ill.

[21] Appl. No.: 418,627

[22] Filed: Oct. 10, 1989

[51] Int. Cl.[5] ..... F01C 1/16

[52] U.S. Cl. ..... 418/1; 418/201 2; 418/203

[58] Field of Search ..... 418/1, 84, 88, 203

[56] References Cited

U.S. PATENT DOCUMENTS

| | | | |
|---|---|---|---|
| Re. 29,283 | 6/1977 | Shaw | 417/282 |
| Re. 32,055 | 12/1985 | Schibbye et al. | 418/1 |
| 3,388,854 | 6/1968 | Olofsson et al. | 230/143 |
| 3,535,057 | 10/1970 | Kodra | 418/1 |
| 3,811,805 | 5/1974 | Moody | 418/203 X |
| 4,017,223 | 4/1977 | Blackwell | 418/107 |
| 4,180,089 | 12/1979 | Webb | 137/115 |
| 4,443,170 | 4/1984 | Schibbye | 418/203 |
| 4,516,914 | 6/1985 | Murphy et al. | 417/282 |
| 4,519,748 | 5/1985 | Murphy et al. | 417/45 |
| 4,609,329 | 9/1986 | Pillis et al. | 417/282 |
| 4,610,613 | 9/1986 | Szymaszek | 418/195 |

FOREIGN PATENT DOCUMENTS

| | | | |
|---|---|---|---|
| 667108 | 3/1937 | Fed. Rep. of Germany | 418/203 |

*Primary Examiner*—Michael Koczo
*Assistant Examiner*—Douglas J. Makosy
*Attorney, Agent, or Firm*—Wood, Phillips, Mason, Recktenwald & Vansanten

[57] ABSTRACT

A system and method are provided for the automatic regulation of a balancing pressure to be applied to a rotor of a rotary screw compressor. The system includes a microprocessor which computes a balancing pressure to be applied to the rotor in response to an input of various compressor operating parameters such as suction pressure, discharge pressure, and percent capcity.

40 Claims, 3 Drawing Sheets

AUTOMATIC REGULATION OF BALANCING PRESSURE IN A SCREW COMPRESSOR

FIELD OF THE INVENTION

This invention generally relates to compressors and, more particularly, to a system and method for the automatic regulation of a balancing pressure to be applied to a rotor in a rotary screw compressor.

BACKGROUND OF THE INVENTION

Rotary screw compressors of the type wherein a gas is introduced through an intake port into compressor rotors, and discharged through a discharge port in a compressed state are well known in the art. In these compressors, an inherent pressure differential exists between the intake or suction side and the outlet or discharge side of the compressor which tends to force the rotors to move toward the intake side In order to balance the rotors, it is known to utilize an oil pump or discharge pressure to provide hydraulic pressure acting on pistons located on the intake or suction side of the rotors which bias the rotors against the pressure differential. A problem with such compressors is that the balancing pressure on the pistons is not responsive to the various operating parameters other than outlet pressure of the rotary screw compressor There is a need for a rotary screw compressor wherein the balancing pressure applied to the pistons is responsive to the various operating parameters thereof. This invention is directed to satisfying this need

SUMMARY OF THE INVENTION

An object, therefore, of the invention is to provide a new and improved rotary screw compressor of the character described.

In the exemplary embodiment of the invention, a rotary screw compressor is provided with a casing having intersecting cylindrical cavities within which meshing male and female rotors are located on parallel axes. The compressor includes an inlet at a low pressure end and an outlet at a high pressure end. Further, the compressor includes means for sensing the pressure of a gas flowing through the inlet, means for sensing the pressure of the gas flowing through the outlet, and microprocessor control means for computing a balancing pressure, in response to inputs or sensed parameters of the pressure of the gas sensed at the inlet and the outlet, which is applied to the male rotor to adjust the relative longitudinal position thereof.

According to the invention, the male and female rotors include shafts extending axially into first and second cylindrical bores in an inlet housing at the low pressure end of the casing and in first and second cylindrical bores in an outlet housing at the high pressure end of the casing. A piston is located within a chamber defined by a portion of the first cylindrical bore and attached to an end of the male rotor shaft such that the balancing pressure counters the shaft forces The piston and shaft may move axially within the first cylindrical bore to apply the balancing pressure.

Further, the compressor includes an oil pump associated with the compressor including conduit means for supplying oil at balancing pressure to the chamber for moving the piston and shaft axially and adjusting the relative longitudinal position of the male rotor.

Still further, a modulating valve is provided between the oil pump and the chamber for regulating the flow of oil from the pump to the chamber. The valve is responsive to the balancing pressure signal computed by the microprocessor means.

Additionally, the compressor has means for controlling the capacity of the compressor.

Means are provided for sensing the position or flow of the capacity control means and feeding the same to the microprocessor control means for computing the balancing pressure to be applied to the male rotor.

Still further, the compressor is provided with a check valve, and means, flowing through the check valve, for applying pressure to the male rotor at outlet pressure rather than balancing pressure.

Other objects and features of the invention will be apparent from the following detailed description taken in connection with the accompanying drawings

BRIEF DESCRIPTION OF THE DRAWINGS

The features of this invention which are believed to be novel are set forth with particularlity in the appended claims. The invention, together with its objects and the advantages thereof, may be best understood by reference to the following description taken in conjunction with the accompanying drawings, and which like reference numerals identify like element in the figures and which:

DETAILED DESCRIPTION OF THE PREFERRED EMBODIMENT

Figure 1:
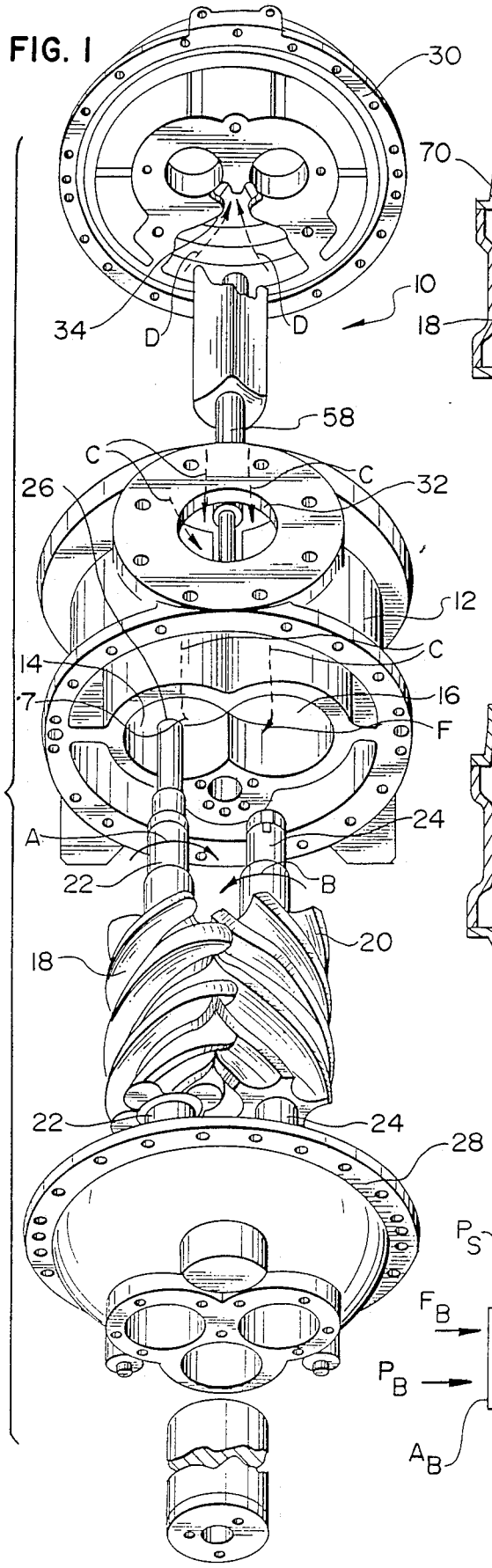
FIG. 1 is an exploded perspective view of the components of a typical rotary screw compressor.

Referring to the drawings in greater detail, and first to FIG. 1, a typical rotary screw compressor, generally designated 10, is illustrated. The term "compressor" is used herein and in the claims hereof generically to include a prime mover that operates in a reverse mode such as a turbine, expander or the like.

As shown therein, rotary screw compressor 10 includes a casing 12 having intersecting cylindrical cavities 14 and 16 within which meshing male and female rotors 18 and 20, respectively, are mounted on parallel axes. The male rotor 18 and female rotor 20 include shafts 22 and 24, respectively. Shaft 22 of male rotor 18 is connected at one end 26 to a drive shaft (not shown) which drives shaft 22 and, therefore, male rotor 18 to rotate in the direction of arrow A, which in turn drives rotor 20 in the direction of arrow B.

The compressor 10 further includes an inlet housing 28 at a low pressure end of casing 12, and an outlet housing 30 at a high pressure end of casing 12. Casing 12 includes an opening 32 through which a gas enters and travels in the direction of arrows C into the rotors 18, 20. An outlet or discharge port 34 is located within outlet housing 30 for the flow of compressed gas in the direction of arrows D.

Figure 2:
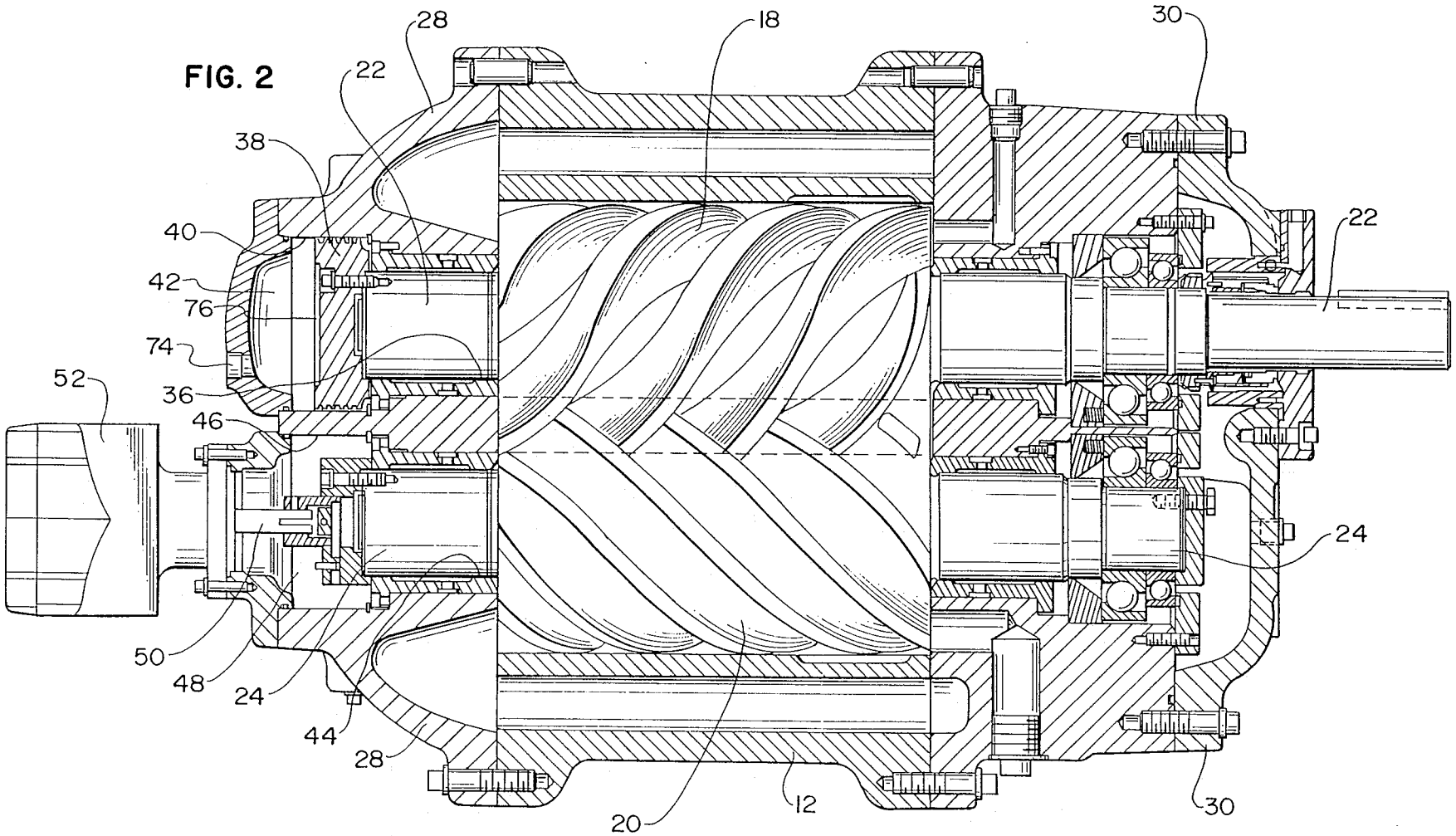
FIG. 2 is a horizontal section of a typical rotary screw compressor.

As shown in FIG. 2, shaft 22 of male rotor 18 is located within a cylindrical bore 36 in inlet housing 28. Further, a piston 38 is attached to the end of shaft 22 of male rotor 18, and is located within a cylindrical portion 40 of bore 36 which defines a chamber 42. In a like manner, shaft 24 of female rotor 20 is located within a cylindrical bore 44 of inlet housing 28 which includes a portion 46 defining a chamber 48. As shown therein, shaft 24 is connected at one end to a shaft 50 of an oil pump 52.

Figure 3:
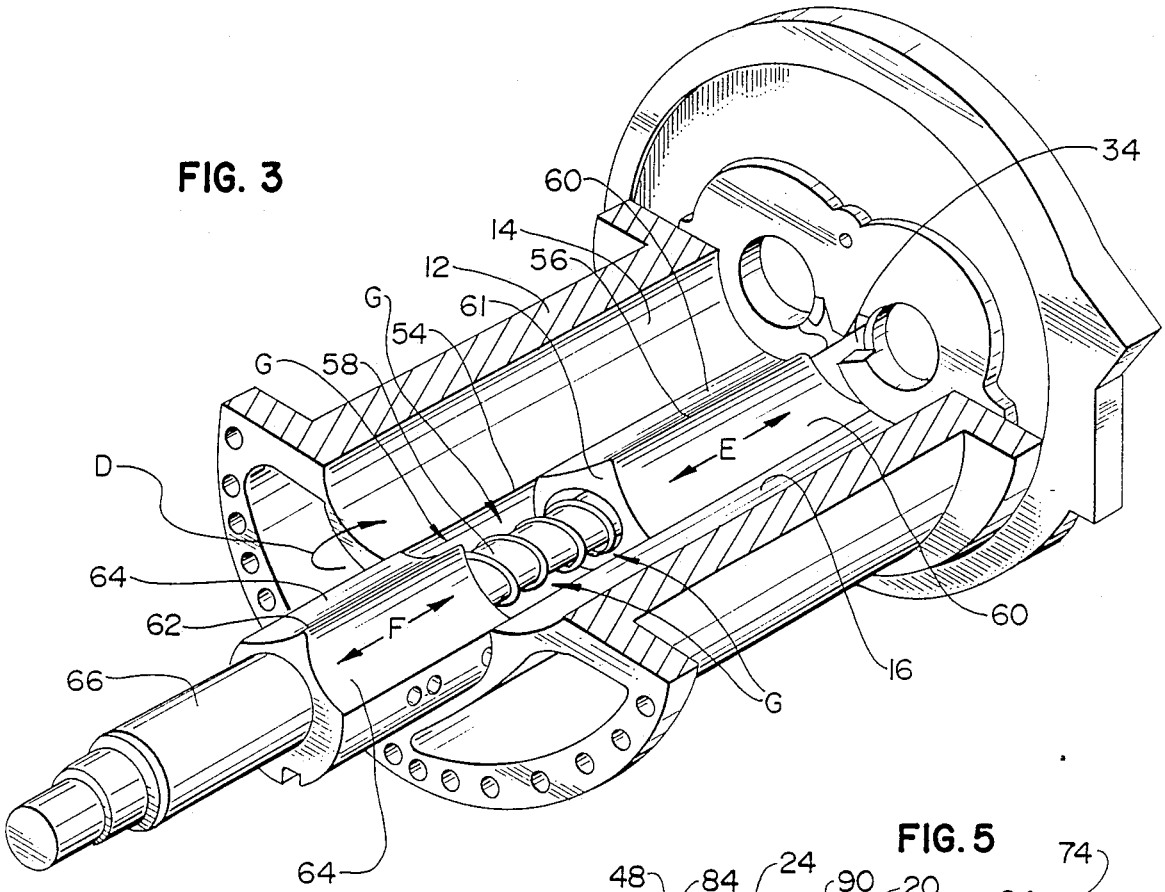
FIG. 3 is a perspective view of the capacity control means, with a section through the casing.

As shown in FIG. 3, the casing 12 of rotary screw compressor 10 further includes an axially extending recess 54 in communication with cylindrical cavities 14, 16. A slide valve 56 is mounted on a shaft 58 for axial movement within recess 54 in the direction of arrows E. As shown therein, slide valve 56 has interfaces 60 in sealing engagement with rotors 18, 20, a front face (not shown) adjacent to outlet or discharge port 34 and a rear face 61.

As further shown in FIG. 3, a slide stop 62 is mounted on a shaft 66 for axial movement within recess 54 in the direction of arrows F. Slide stop 62 has interfaces 64 in sealing engagement with rotors 18, 20, and a front face (not shown) adapted to engage rear face 61 of slide valve 56. Slide stop 62 is movable independently of slide valve 56 to provide an opening of selected size between rear face 61 of slide valve 56 and front face (not shown) of slide stop 62. As indicated by arrows G, the opening allows some of the gas to return to the suction side of cylindrical cavities 14, 16 before compression.

Figure 4A:
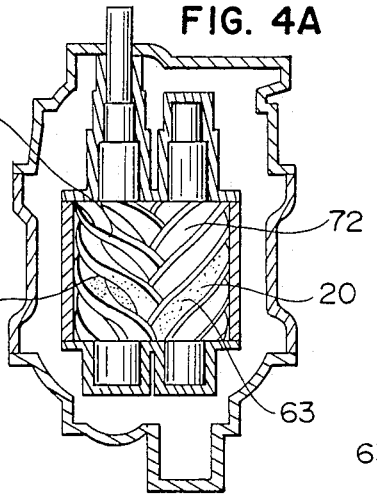
FIGS. 4A–4D illustrate, in a schematic fashion, the compression process in a rotary screw compressor.
Figure 4B:
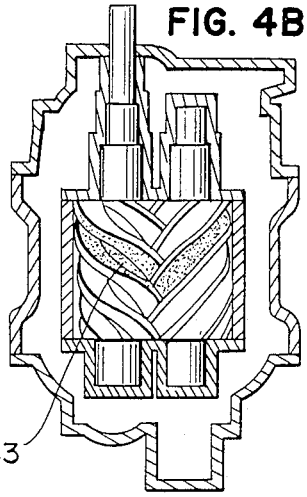
Figure 4C:
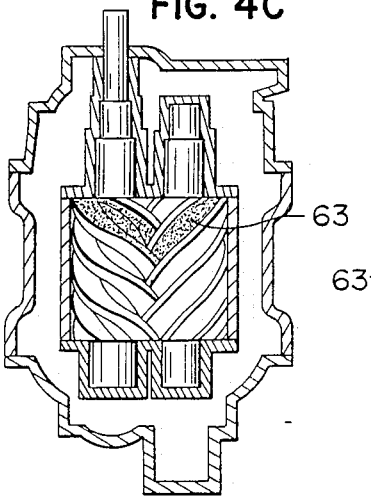
Figure 4D:
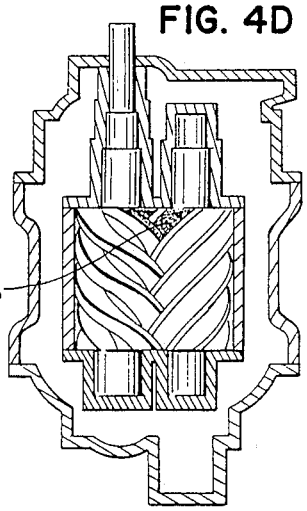

In a typical operation of the rotary screw compressor illustrated in FIGS. 1-3, a gas 63 at an inlet or suction pressure $P_S$ is drawn axially into opening 32 of casing 12 (FIG. 1). Thereafter, as shown in FIG. 4A, gas 63 is drawn into rotors 18, 20. Male rotor 18 includes lobes 70 which function as pistons that roll in cylinders 72 of female rotor 20. Therefore, as rotors 18 and 20 turn, gas 63 is trapped within casing 12 and rotor cylindrical cavities 14, 16, as shown in FIG. 4B. Thereafter, as shown in FIG. 4C, lobes 70 of male rotor 18 reduce the volume in cylinders 72 of female rotor 20 to compress trapped gas 63. The process is completed as shown in FIG. 4D compressed gas 63, at an outlet or discharge pressure $P_D$, is discharged through outlet 34 (FIG. 1).

Due to the inherent pressure differential ($\Delta P = P_D - P_S$) which naturally exists between the inlet or suction side and the outlet or discharge side, rotors 18, 20 normally are forced axially toward the left in FIG. 2. In order to compensate for the leftward movement of the rotors 18, 20, oil pump 52 is used to supply oil at a balancing pressure $P_B$ to chamber 42 via inlet 74. The oil at a balancing pressure $P_B$ acts against a face 76 of piston 38 to force the piston 38 to move male rotor 18 to the right in FIG. 2. Although not shown in FIG. 2, it is understood that a piston could be located within chamber 48 to moVe female rotor 20 to the right in response to the force of oil at a balancing pressure within chamber 48. As shown schematically in FIG. 5, a system, generally designated 74, according to the present invention is provided for automatically regulating the balancing pressure of oil to be supplied to chamber 42 to move piston 38 and, correspondingly, male rotor 18 to the right in FIG. 5.

As shown therein, various operating parameters are sensed and fed to a microprocessor 76 which compares the operating parameters, through an algorithm to be described later, and modulates the balancing pressure $P_B$ of oil to be supplied to chamber 42. The balancing pressure of oil flowing from pump 52 to chamber 42 via conduits 78, 80 is controlled by a modulating or variable throttle valve 82 which opens or closes in response to instructions from processor 76. In the situation wherein female rotor 20 includes a piston 84 within chamber 48, oil at balancing pressure $P_B$ may be supplied to chamber 48 via conduit 86 connected to conduit 80.

Figure 5:
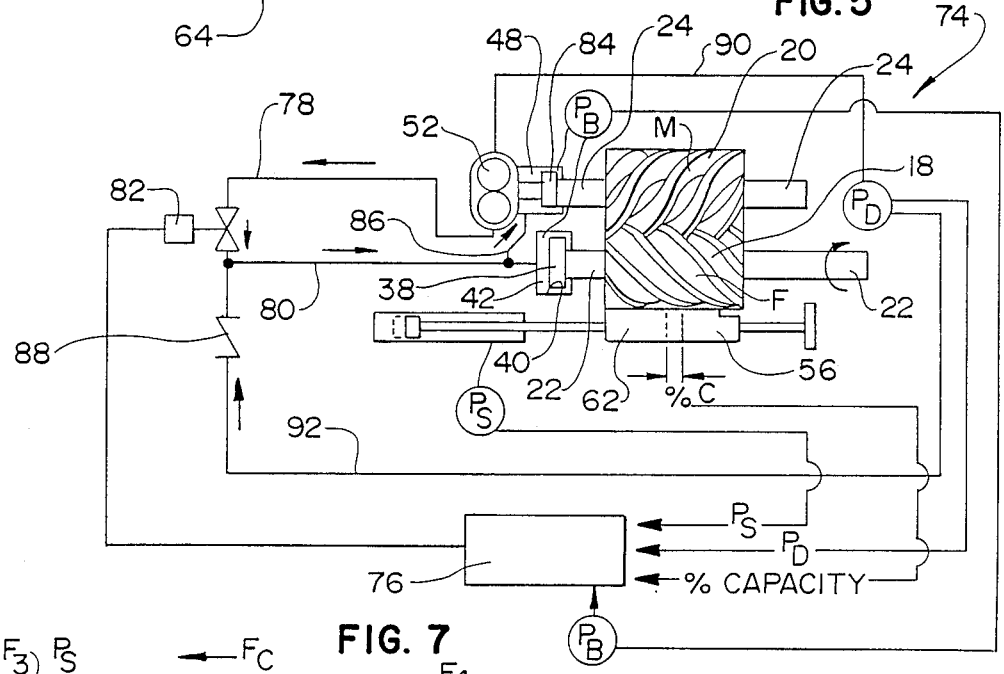
FIG. 5 is a schematic of a system according to the invention for the automatic regulation of a balancing pressure to be applied to a rotor in the compressor.

As shown in FIG. 5, microprocessor 76 is provided with a parameter input of inlet or suction pressure $P_S$ and outlet or discharge pressure $P_D$ to generate a pressure differential ($\Delta P = P_D - P_S$), and an output of balancing pressure $P_B$.

Additionally, and only wherein the compressor includes a capacity control such as slide valve 56 and/or slide stop 62, microprocessor 76 may be provided with an operating input parameter of pump capacity ratio %C which is generated by sensing the axial positions of slide valve 56 and slide stop 62.

Of course, it is understood that the subject invention is not limited to the parameter inputs of $P_S$, $P_D$, and %C, but, rather, is applicable to any other operating input parameters which may have an affect on the balancing pressure of oil to be supplied to chamber 42.

System 74 further includes a check valve 88 and a safety oil circuit 90, 92 for supplying oil to chamber 42, and at outlet or discharge pressure $P_D$ in the event that gear pump 52 fails.

Figure 6:
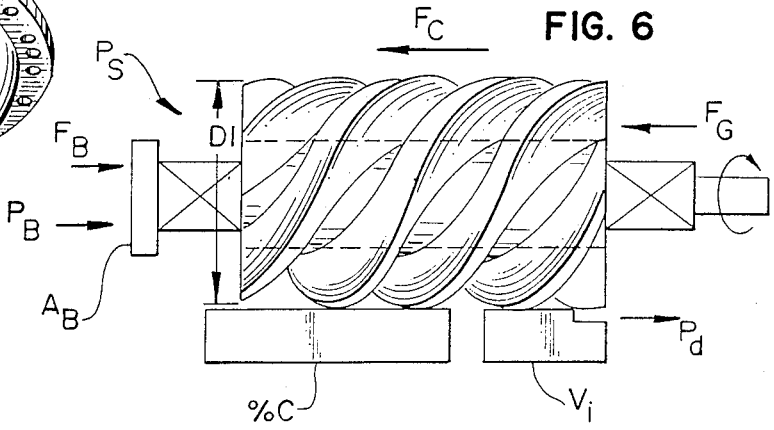
FIGS. 6 and 7 illustrate, in a schematic fashion, the axial forces on a rotary screw compressor.

A generalized control algorithm for system 74 now will be described with reference to FIG. 6. From the forces shown in FIG. 6, it follows that:

$$F_B = F_C + F_G$$

Since $F_B = P_B A_B$, it follows that:

$$P_B = \frac{F_C + F_G}{A_B}$$

Where:

$F_G$ = Gas/oil pressure forces against end of piston $F_B$ = Force to balance rotor loads axially $F_C$ = Compression forces axially f ($D_1^2$, $P_S$, $P_D - P_S$), $V_i$, %C, k)

$P_S$ = Suction pressure $P_D$ = Discharge pressure $P_B$ = Balancing pressure

Figure 7:
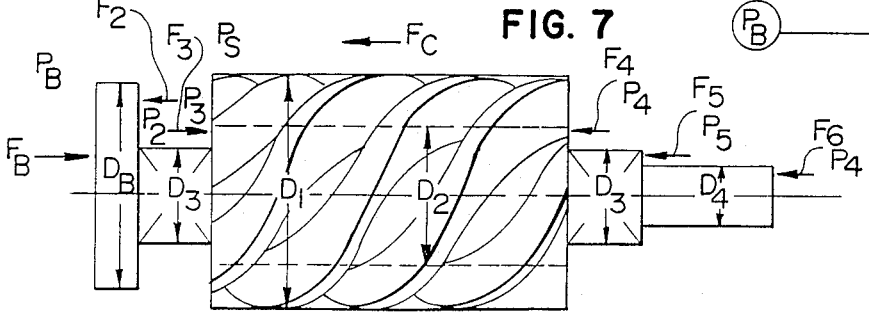

%C = Percent capacity or valve position $V_i$ = Volume ratio k = Specific heat ratio of gas compressed $D_1$ = Diameter of rotor A more detailed control algorithm for system 74 now will be described with respect to FIG. 7. If the rotor shown therein is balanced axially, $$F_B = F_2 - F_3 + F_C + F_4 + F_5 + F_6$$

Since $F_B = P_B A_B$, $F_2 = P_2 A_2$, $F_3 = P_3 A_3$, $F_4 = P_4 A_4$, and $F_5 = P_5 A_5$, it follows that:

$F_6 = F_A A_6$ $$P_B A_B = P_2 A_2 - P_3 A_3 + F_C + P_4 A_4 + P_5 A_5 + P_A A_6$$

Furthermore, $$P_B = \frac{F_C + P_2A_2 - P_3A_3 + P_4A_4 + P_5A_5 + P_AA_6}{A_B}$$

Therefore, $$P_B = \frac{F_C}{A_B} + \frac{P_2(D_B^2 - D_3^2) + (P_4 - P_3)(D_2^2 - D_3^2) + P_5(D_3^2 - D_4^2) + P_AD_4^2}{D_B^2}$$

Where:

$P_B$=Oil pressure in balancing chamber $P_S$=Suction pressure $P_D$=Discharge pressure $P_2$, $P_3$, $P_4$, and $P_5$ are functions of $P_B$, $P_S$, and/or $P_D$ $F_C$=Force of compression gases Specifically, $F_C=f\,[D_1^2, P_s, (P_D-P_S), V_i, \%C, k]$ The present invention thus provides a system for the microprocessor control of the balancing pressure of oil to be applied to a rotor which is superior to the prior art. The present invention also provides for an operating parameter input of pump capacity ratio %C in a system for controlling the balancing pressure.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A rotary screw compressor including:

a casing having intersecting cylindrical cavities within which meshing male and female rotors are located on parallel axes;

an inlet at a low pressure end of the compressor and an outlet at a high pressure end of the compressor;

means for sensing the pressure of a gas flowing through said inlet;

means for sensing the pressure of said gas flowing through said outlet;

pressure applying means for applying a balancing pressure to at least one of the rotors to adjust the longitudinal position thereof; and microprocessor control means coupled to said pressure applying means for controlling the same as a function of said balancing pressure computed in response to an input of said pressure of said gas sensed at the inlet and the outlet.

2. The compressor of claim 1, wherein said male and female rotors include shafts extending axially into first and second cylindrical bores in an inlet housing at the low pressure end of the casing and into first and second cylindrical bores in an outlet housing at the high pressure end of the casing.

3. The compressor of claim 2, further including a piston located within a chamber defined by a portion of said first cylindrical bore and attached to an end of said male rotor shaft such that said piston and shaft are movable axially within said first cylindrical bore.

4. The compressor of claim 3, further including an oil pump having conduit means for supplying oil at balancing pressure to said chamber for moving said piston and shaft axially and adjusting the relative longitudinal position of said male rotor.

5. The compressor of claim 4, further including a modulating valve between said oil pump and said chamber for regulating the flow of oil from said pump to said chamber, said valve being responsive to the balancing pressure computed by said microprocessor means.

6. The compressor of claim 5, further including a second piston located within a second chamber defined by a portion of said second cylindrical bore and attached to an end of said female rotor shaft such that said second piston and shaft are moVably axially within said second cylindrical bore, said conduit means supplying oil under pressure to said second chamber for moving said second piston and shaft axially in adjusting the relative longitudinal position of said female rotor.

7. The compressor of claim 4, further including means connecting the oil pump to the female rotor whereby the oil pump is driven by the female rotor.

8. The compressor of claim 4, further including a check valve, and conduit means between said outlet and said chamber, through said check valve, for applying pressure to said male rotor at outlet pressure rather than balancing pressure.

9. The compressor of claim 1, further including an axially extending recess in the casing in communication with said intersecting cylindrical cavities, said recess including means for controlling the capacity of said compressor.

10. The compressor of claim 9, wherein said means for controlling the capacity of said compressor comprises a slide valve and a slide stop mounted for axial movement within said recess.

11. The compressor of claim 9, further including means for sensing the position of said capacity control means as an input to said microprocessor control means for computing said balancing pressure to be applied to said male rotor.

12. A rotary screw compressor including:

a casing having intersecting cylindrical cavities within which meshing male and female rotors are located on parallel axes;

an inlet at a low pressure end of the compressor and an outlet at a high pressure end of the compressor;

an axially extending recess in the casing in communication with said intersecting cylindrical cavities, said recess including means for controlling the capacity of said compressor;

means for sensing the pressure of a gas flowing through said inlet;

means for sensing the pressure of said gas flowing through said outlet;

means for sensing the position of said capacity control means;

pressure applying means for applying a balancing pressure to at least one of the rotors to adjust the longitudinal position thereof; and microprocessor control means coupled to said pressure applying means for controlling the same as a function of said balancing pressure computed in response to an input of said pressure of said gas at the inlet and the outlet and said position of said capacity control means.

13. The compressor of claim 12, wherein said male and female rotors include shafts extending axially into first and second cylindrical bores in an inlet housing at the low pressure end of the casing and into first and second cylindrical bores in an outlet housing at the high pressure end of the casing.

14. The compressor of claim 13, further including a piston located within a chamber defined by a portion of said first cylindrical bore and attached to an end of said male rotor shaft such that said piston and shaft are movable axially within said first cylindrical bore.

15. The compressor of claim 14, further including an oil pump having conduit means for supplying oil at balancing pressure to said chamber for moving said piston and shaft axially and adjusting the relative longitudinal position of said male rotor.

16. The compressor of claim 15, further including a modulating valve between said oil pump and said chamber for regulating the flow of oil from said pump to said chamber, said valve being responsive to the balancing pressure computed by said microprocessor means.

17. The compressor of claim 15, further including a second piston located within a second chamber defined by a portion of said second cylindrical bore and attached to an end of said female rotor shaft such that said second piston and shaft are movably axially within said second cylindrical bore, said conduit means supplying oil under pressure to said second chamber for moving said second piston and shaft axially and adjusting the relative longitudinal position of said female rotor.

18. The compressor of claim 15, further including means connecting the oil pump to the female rotor whereby the oil pump is driven by the female rotor.

19. The compressor of claim 15, further including a check valve, and conduit means between said outlet and said chamber, through said check valve, for applying pressure to said male rotor at outlet pressure.

20. The compressor of claim 12, wherein said means for controlling the capacity of said compressor comprises a slide valve and a slide stop mounted within said recess for axial movement.

21. A rotary screw compressor including:

a casing having intersecting cylindrical cavities within which meshing male and female rotors are located on parallel axes;

an inlet at a low pressure end of the compressor and an outlet at a high pressure end of the compressor;

means for sensing the pressure of a gas flowing through said inlet;

means for sensing the pressure of said gas flowing through said outlet;

means for sensing the position of a capacity control means mounted for axial movement within an axially extending recess in the casing;

pressure applying means for applying a balancing pressure to at least one of the rotors to adjust the longitudinal position thereof; and means responsive to said inlet and outlet pressure and said position of said capacity control means coupled to said pressure applying means for controlling the same as a function of said balancing pressure.

22. The compressor of claim 21, wherein said responsive means comprises a microprocessor control coupled to said pressure applying means for controlling the same as a function of said balancing pressure computed in response to an input of said pressure of said gas at the inlet and the outlet and said position of said capacity control means.

23. The compressor of claim 22, wherein said male and female rotors include shafts extending axially into first and second cylindrical bores in an inlet housing at the low pressure end of the casing and into first and second cylindrical bores in an outlet housing at the high pressure end of the casing.

24. The compressor of claim 23, further including a piston located within a chamber defined by a portion of said first cylindrical bore and attached to an end of said male rotor shaft such that said piston and shaft are movable axially within said first cylindrical bore.

25. The compressor of claim 24, further including an oil pump having conduit means for supplying oil at balancing pressure to said chamber for moving said piston and shaft axially and adjusting the relative longitudinal position of said male rotor.

26. The compressor of claim 25, further including a modulating valve between said oil pump and said chamber for regulating the flow of oil from said pump to said chamber, said valve being responsive to the balancing pressure computed by said microprocessor means.

27. The compressor of claim 21, wherein said means for controlling the capacity of said compressor comprises a slide valve and a slide stop mounted for axial movement within said recess.

28. A method for regulating a balancing pressure in a rotary screw compressor including a casing having intersecting cylindrical cavities within which meshing male and female rotors are located on parallel axes, said compressor including an inlet at a low pressure end and an outlet at a high pressure end, comprising:

sensing the pressure of a gas flowing through said inlet;

sensing the pressure of said gas flowing through said outlet;

feeding said pressures sensed at said inlet and outlet to a microprocessor control means which generates a balancing pressure to be applied to said male rotor to adjust the relative longitudinal position thereof

29. The method of claim 28, wherein said balancing pressure is applied to said male rotor by supplying oil from an oil pump to a chamber defined by a portion of a first cylindrical bore in an inlet housing at a low pressure end of said casing, said oil moving a piston located within said chamber and attached to an end of a shaft of said male rotor extending axially into said first cylindrical bore to adjust the relative longitudinal position of said male rotor.

30. The method of claim 29, wherein the flow of oil from said pump to said chamber is regulated by means of a modulating valve which opens and closes in response to the balancing pressure generated by said microprocessor control means.

31. The method of claim 29, further including the step of supplying oil to a chamber defined by a portion of a second cylindrical bore within said inlet housing, said oil moving a piston located within said chamber and attached to an end of a shaft of said female rotor extending axially into said second cylindrical bore to adjust the relative longitudinal position of said female rotor.

32. The method of claim 29, further including the step of sensing the position of a capacity control means mounted for axial movement within an axially extending recess in the casing and feeding said position to said microprocessor control means for generating said balancing pressure to be applied to said male rotor.

33. The method of claim 29, wherein said oil pump is driven by said female rotor.

34. The method of claim 29, further including the step of supplying oil to said chamber at outlet pressure instead of at said balancing pressure, said oil at said outlet pressure being supplied by means of a check valve, and conduit means between said outlet and said chamber, through said check valve.

35. A method for regulating a balancing pressure in a rotary screw compressor including a casing having intersecting cylindrical cavities within which meshing male and female rotors are located on parallel axes, said compressor including an inlet at a low pressure end and an outlet at a high pressure end, comprising:

sensing the pressure of a gas flowing through said inlet;

sensing the pressure of said gas flowing through said outlet;

sensing the position of a capacity control means mounted for axial movement within an axially extending recess in the casing; and feeding said pressures sensed at said inlet and outlet and said position of said capacity control means to a microprocessor control means for the generation of a balancing pressure to be applied to said male rotor.

36. The method of claim 35, Wherein said balancing pressure is applied to said male rotor by supplying oil from an oil pump to a chamber defined by a portion of a first cylindrical bore in an inlet housing at a low pressure end of said casing, said oil moving a piston located within said chamber and attached to an end of a shaft of said male rotor extending axially into said first cylindrical bore to adjust the relative longitudinal position of said male rotor.

37. The method of claim 36, wherein the flow of oil from said pump to said chamber is regulated by means of a modulating valve which opens and closes in response to the balancing pressure generated by said microprocessor control means.

38. The method of claim 36, further including the step of supplying oil to a chamber defined by a portion of a second cylindrical bore within said inlet housing, said oil moving a piston located within said chamber and attached to an end of a shaft of said female rotor extending axially into said second cylindrical bore to adjust the relative longitudinal position of said female rotor.

39. The method of claim 36, wherein said oil pump is driven by said female rotor.

40. The method of claim 36, further including the step of supplying oil to said chamber at outlet pressure instead of at said balancing pressure, said oil at said outlet pressure being supplied by means of a check valve, and conduit means between said outlet and said chamber, through said check valve.

* * * * *